US009388524B2

(12) United States Patent
Cho et al.

(10) Patent No.: US 9,388,524 B2
(45) Date of Patent: Jul. 12, 2016

(54) WASHING MACHINE

(75) Inventors: Hwang Mook Cho, Hwaseong-si (KR); Sung Hoon Kim, Suwon-si (KR); Jae Ryong Park, Hwaseong-si (KR); Eun Suk Bang, Hwaseong-si (KR); Dong Pil Seo, Hwaseong-si (KR); Ji Yu Lee, Incheon (KR); Sang Yeon Pyo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 762 days.

(21) Appl. No.: 13/564,123

(22) Filed: Aug. 1, 2012

(65) Prior Publication Data

US 2013/0031938 A1 Feb. 7, 2013

(30) Foreign Application Priority Data

Aug. 1, 2011 (KR) ..... 10-2011-0076436

(51) Int. Cl.
*D06F 13/02* (2006.01)
*D06F 39/08* (2006.01)

(52) U.S. Cl.
CPC ..... *D06F 39/081* (2013.01); *D06F 13/02* (2013.01)

(58) Field of Classification Search
CPC ..... D06F 13/02
See application file for complete search history.

(56) References Cited

U.S. PATENT DOCUMENTS 3,807,201 A * 4/1974 Gorsuch ..... 68/23 R

FOREIGN PATENT DOCUMENTS

| | | |
|---|---|---|
| FR | 1153863 | 3/1958 |
| GB | 625326 | 6/1949 |

OTHER PUBLICATIONS

Extended European Search Report for European Application No. 12178477.1, mailed Dec. 21, 2012.

* cited by examiner

*Primary Examiner* — Jason Ko
(74) *Attorney, Agent, or Firm* — Staas & Halsey LLP

(57) ABSTRACT

A washing machine capable of increasing the washing capacity without enlarging the external appearance and also discharging a washing water during a washing operation or a spin-dry operation while completely isolated from electronic parts and thus reducing the risk of a power failure and fire, the washing machine including a body, a rotating tub rotatably disposed inside the body, a pulsator rotatably disposed inside the rotating tub, a driving part provided on a lower portion of the rotating tub to selectively rotate the rotating tub and the pulsator, a base plate to which the driving part is fixed, wherein a waterproofing member is provided between the base plate and a bottom of the body to seal the driving part and to prevent water from reaching the driving part.

19 Claims, 6 Drawing Sheets

WASHING MACHINE

CROSS-REFERENCE TO RELATED APPLICATIONS

This application claims the priority benefit of Korean Patent Application No. 2011-0076436, filed on Aug. 1, 2011 in the Korean Intellectual Property Office, the disclosure of which is incorporated herein by reference.

BACKGROUND

1. Field

Embodiments relate to a washing machine.

2. Description of the Related Art

A washing machine is an apparatus configured to wash laundry by use of electric power. In general, the washing machine includes a tub configured to store a washing water, a rotating tub rotatably installed inside the tub, a pulsator rotatably installed on the bottom of the rotating tub, and a motor and a clutch that are configured to rotate the rotating tub and the pulsator.

In a state that a laundry and a washing water containing detergent are input in the rotating tub, and if the rotating tub and the pulsator rotate, the pulsator stirs the washing water together with the laundry to remove dirt on the laundry.

In order to increase the washing capacity of a washing machine, the rotating tub needs to be larger, that is, the rotating tub needs to be increased in diameter or in height. If a rotating tub has a larger size, a tub accommodating the rotating tub and a cabinet accommodating the tub also need to be enlarged along with the increase of the rotating tub.

The enlarging of a cabinet, which corresponds to an external appearance of the washing machine, is limited by the space of an installation area. In addition, for a vertical-shaft washing machine, the increased height of a washing machine causes a difficulty in loading and unloading laundry. Accordingly, there is a need for a washing machine be capable of eliminating such an inconvenience and yet increasing the washing capacity.

SUMMARY

In an aspect of one or more embodiments, there is provided a washing machine capable of increasing the washing capacity without enlarging the external appearance.

In an aspect of one or more embodiments, there is provided a washing machine capable of discharging a washing water during a washing operation or a spin-dry operation while completely isolated from electronic parts and thus reducing the risk of a power failure and fire.

In accordance with an aspect of one or more embodiments, there is provided a washing machine includes a body, a rotating tub, a pulsator, a driving part and a base plate. The rotating tub is rotatably disposed inside the body. The pulsator is rotatably disposed inside the rotating tub. The driving part is provided on a lower portion of the rotating tub to selectively rotate the rotating tub and the pulsator. The base plate has the driving part fixed thereto. A waterproofing member is provided between the base plate and a bottom of the body to seal the driving part and to prevent water from being infiltrated into (reaching) the driving part.

The waterproofing member includes a diaphragm configured to absorb vibration of the driving part.

The waterproofing member includes a plurality of wrinkled parts, a first fixing part extending upward from the wrinkled part, and a second fixing part extending downward from the wrinkled part.

The base plate includes a first coupling part which is provided at a lower surface of the base plate such that the first coupling part is coupled with the first fixing part.

The washing machine further includes a mounting part configured to support the body, wherein the mounting part includes a bottom plate forming the bottom of the body and a second coupling part which is provided at a lower surface of the bottom plate to be coupled with the second fixing part.

The waterproofing member further includes a wire which is provided in a form of a ring and configured to press and fix each of outer sides of the first fixing part and the second fixing part.

The mounting part further includes a moisture infiltration preventing guide configured to prevent water from being infiltrated to (reaching) a cable that is withdrawn from the driving part.

The moisture infiltration preventing guide is vertically provided inside the body.

The rotating body includes a side wall that extends from a bottom of the rotating body while being slanted with increase of a diameter, and at least one drain hole is formed in an upper end portion of the side wall.

The bottom plate is provided with a first drain port configured to discharge a washing water that is discharged through the drain hole and fallen.

The driving part includes a motor, a clutch configured to selectively transfer a power of the motor to the rotating tub and the pulsator, and a flange connecting a driving shaft of the clutch to a bottom of the rotating tub, and The flange includes a first through-hole, which is provided in a center of the flange to allow the driving shaft to be coupled thereto, and a second through-hole, which is formed around the first through-hole in a circumferential direction of the first through-hole to pass water during a washing operation and a rinsing operation.

The based plate is provided with a second drain port configured to discharge a washing water that is discharged through the second through-hole and fallen during a washing operation or a rinsing operation.

The washing machine further includes a suspension member connecting the base plate to a upper portion of the body, wherein the suspension member has a first end connected to at least one connecting bracket, which is provided on the base plate, and a second end connected to an upper edge of the body.

In accordance with an aspect of one or more embodiments, there is provided a washing machine includes a body, a rotating but, a base plate and a diaphragm. The body forms an external appearance. The rotating tub is rotatably installed inside the body and is provided at a lower portion thereof with a driving part. The base plate is connected to an upper portion of the body by at least one suspension member such that the driving part is fixed to the base plate. The diaphragm is disposed between the base plate and a bottom of the body to seal the driving part and to absorb vibration.

The diaphragm includes a plurality of wrinkled parts and a fixing part extending upward and downward from the wrinkled part.

The base plate includes a coupling groove that is formed by protruding a lower surface of the base plate such that a first side of the fixing part is fixed to the base plate.

The bottom of the body is provided at a center thereof with an installation hole that allows the driving part to pass therethrough, and wherein a rim of the installation hole is bent downward such that a second side of the fixing part is fixed to the rim.

The washing machine further includes a wire which is provided in a form of a ring and configured to press and fix an outer circumference of the fixing part.

The washing machine further includes a moisture water infiltration preventing guide which is provided on the bottom of the body to prevent water from being infiltrated to (reaching) a cable that is withdrawn from the driving part.

In an aspect of one or more embodiments, there is provided a washing machine which can increase the washing capacity without enlarging the external appearance and thus can wash a larger amount of laundry at one time, thereby enhancing the washing efficiency.

According to an aspect of one or more embodiments, the same washing capacity is ensured with a smaller external appearance, so that the installation is less affected by a limited installation space. In addition, the laundry can be easily loaded and unloaded, thereby improving the convenience of a user.

In addition, a washing water discharged during a washing operation or a spin-dry operation is completely isolated from electronic and installed parts, and the risk of a power failure and fire is reduced. In addition, one or more embodiments may prevent a rotating body from colliding with a wall surface in an abnormal vibration state, thereby ensuring the stability of the washing machine.

BRIEF DESCRIPTION OF THE DRAWINGS

These and/or other aspects of embodiments will become apparent and more readily appreciated from the following description, taken in conjunction with the accompanying drawings of which.

DETAILED DESCRIPTION

Figure 1:
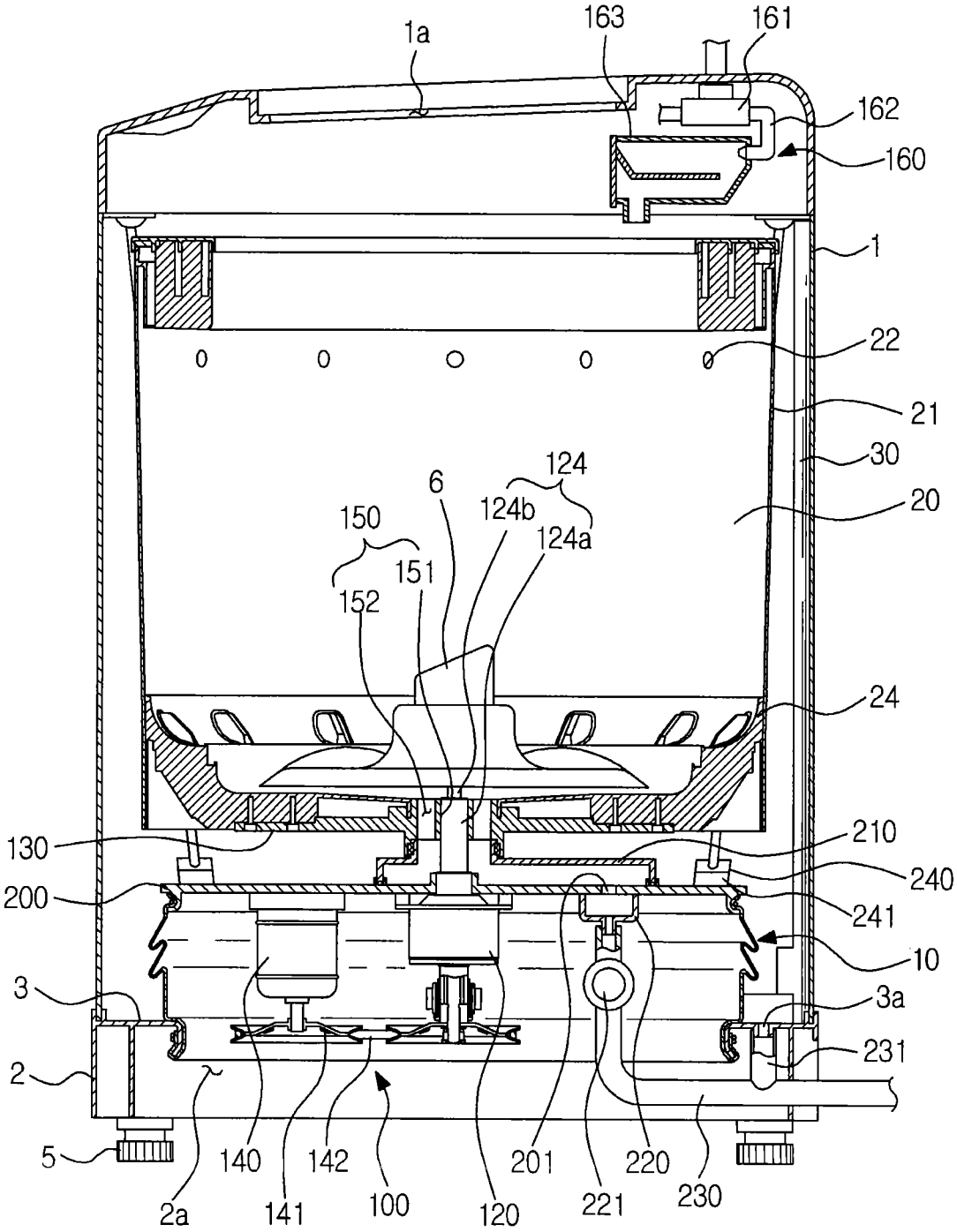
FIG. 1 is a cross-sectional view schematically illustrating a washing machine according to an embodiment.

Reference will now be made in detail to embodiments, examples of which are illustrated in the accompanying drawings, wherein like reference numerals refer to like elements throughout.

FIG. 1 is a cross-sectional view schematically illustrating a washing machine according to an embodiment.

Referring to FIG. 1, a washing machine includes a body 1 forming an external appearance of the washing machine, a rotating tub 20 rotatably disposed inside the body 1, and a driving part 100 disposed at a lower portion of the rotating tub 20 to rotate the rotating tub 20.

The body 1 is provided at a upper portion thereof with a laundry input port 1*a*, which allows laundry to be input into the rotating tub 20 therethrough, and with a door (not shown) configured to open and close the laundry input port 1*a*.

The body 1 is provided at a lower portion thereof with a mounting part 2 having a leg 5 that enables the washing machine to be mounted on a floor.

The rotating tub 20 is rotatably disposed inside the body 1. A plurality of drain holes 22 are formed at an upper portion of the rotating tub 20 along a circumference of the rotating tub 20.

A pulsator 6 is rotatably installed at a bottom of the rotating tub 20. The pulsator 6 serves to stir a washing water introduced into the rotating tub 20 together with a laundry.

A water supply apparatus 160 is installed at an upper side of the rotating tub 20 to supply a washing water to the rotating tub 20. The water supply apparatus 160 includes a water supply valve 161 configured to regulate a supply of water and a water supply pipe 162 connecting the water supply valve 161 to a detergent supply apparatus 163.

The water delivered through the water supply pipe 162 is supplied to the rotating tub 20 together with detergent by passing through the detergent supply apparatus 163.

A first drain hose 231 and a second drain hose 230 are provided at the lower portion of the rotating tub 20 to guide a washing water, which has been used for a washing operation or a spin-dry operation, to the outside the body 1.

The driving part 100 includes a clutch 120, which rotates the rotating tub 20 and the pulsator 6, and a driving motor 110, which drives the clutch 120.

The clutch 120 is connected to the driving motor 110 through a pulley 141 and a belt 142 such that a driving force of the driving motor 110 is selectively transferred to the rotating tub 20 or the pulsator 6.

Figure 2:
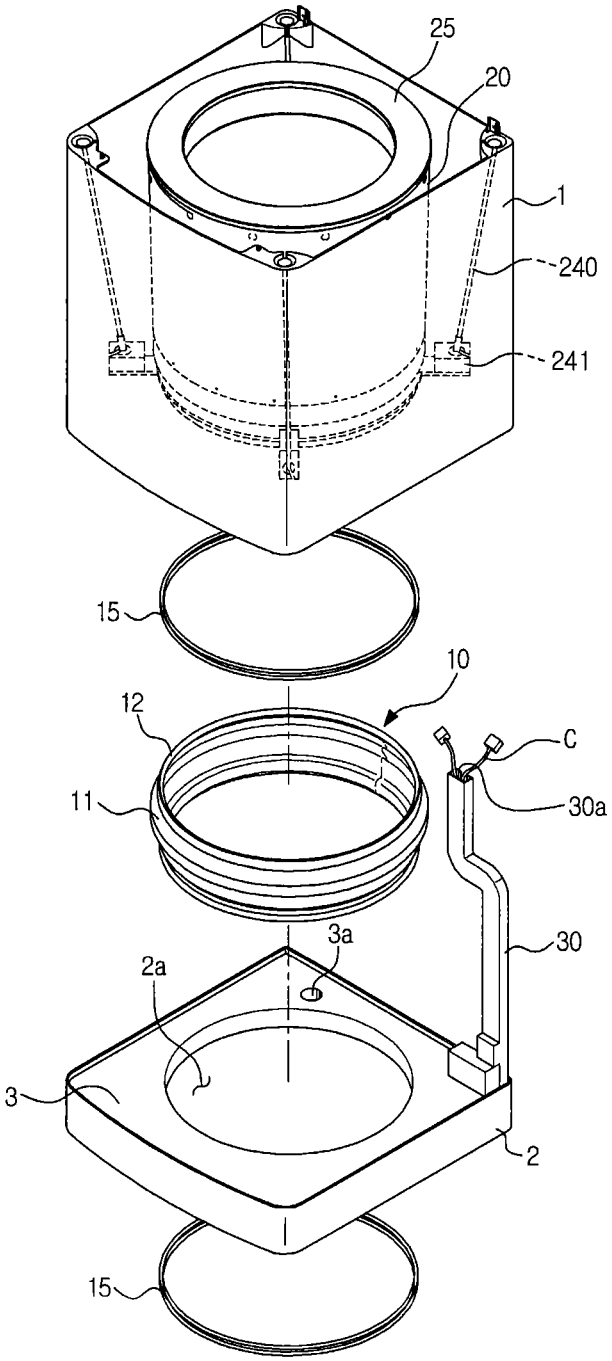
FIG. 2 is an exploded perspective view schematically illustrating the washing machine according to embodiment.
Figure 3:
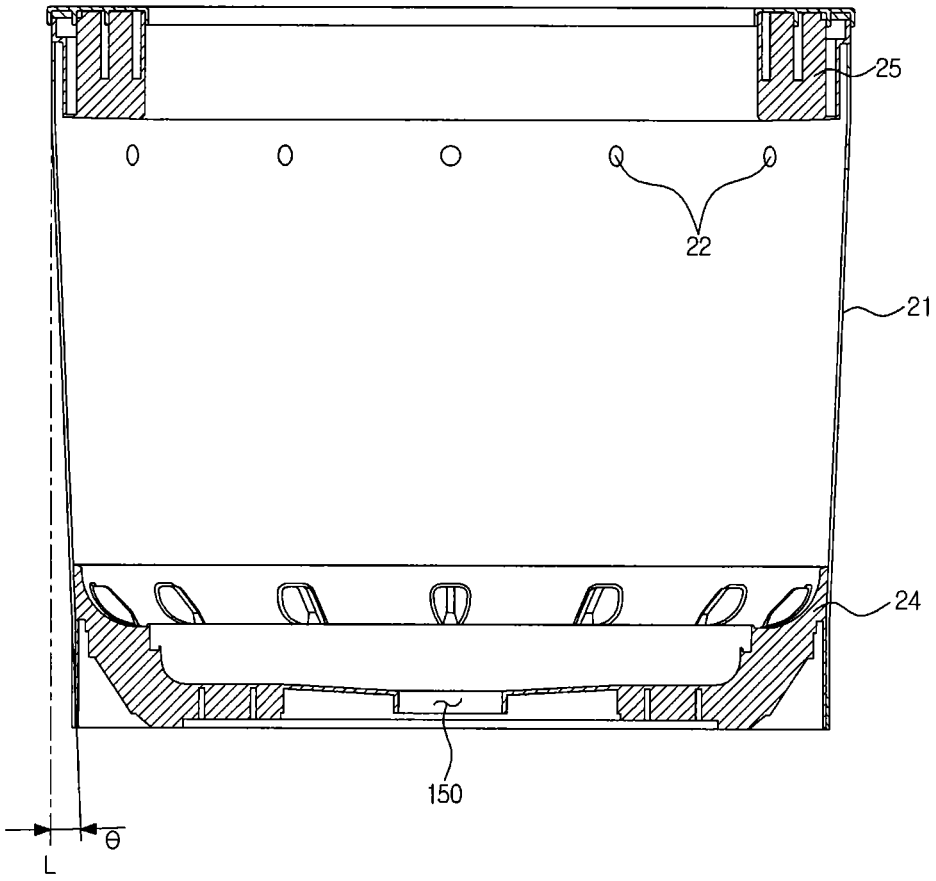
FIG. 3 is a cross-sectional view schematically illustrating a rotating tub of the washing machine according to embodiment.
Figure 4:
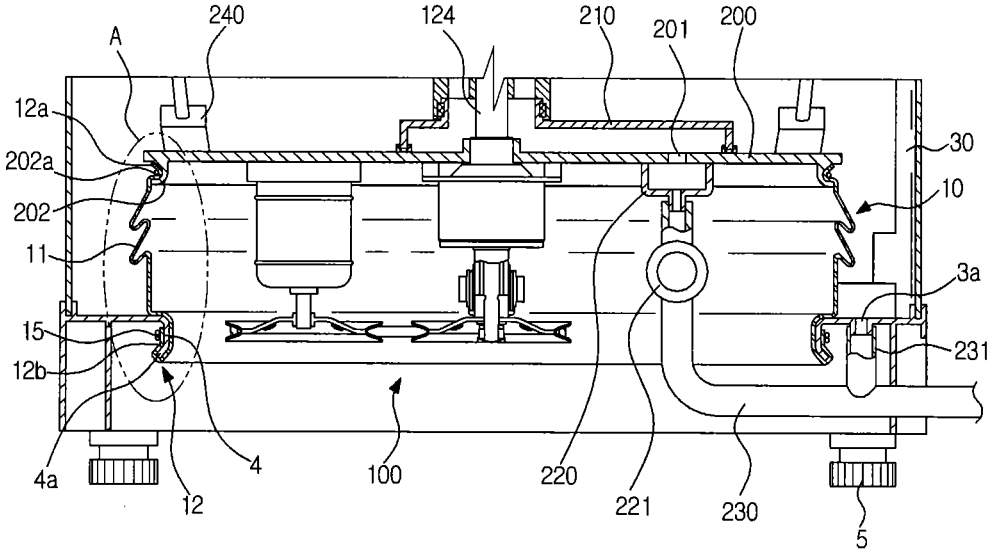
FIG. 4 is a cross-sectional view schematically illustrating a driving part and a waterproofing member of the washing machine according to embodiment.

FIG. 2 is an exploded perspective view schematically illustrating the washing machine according to an embodiment. FIG. 3 is a cross-sectional view schematically illustrating a rotating tub of the washing machine according to an embodiment. FIG. 4 is a cross-sectional view schematically illustrating a driving part and a waterproofing member of the washing machine according to an embodiment.

Referring to FIGS. 2 to 4, the rotating tub 20 is disposed inside the body 1 while being spaced apart from the inside the body 1 by a predetermined interval.

A suspension member 240 is installed on an outer side of the rotating tub 20 such that the rotating tub 20 is hung on the body 1 while being supported by the suspension 240.

In order to support the rotating tub 20, one side of the suspension member 240 is coupled to the upper portion of the body 1 and the other side of the suspension member 240 is coupled to a connecting bracket 241 of a base plate 200 that are to be described later.

The body 1 is provided at the lower portion thereof with the mounting part 2 that is configured to support the body 1.

The mounting part 2 includes a bottom plate 3 forming the bottom of the body 1 and an installation hole 2*a* formed through the center of the mounting part 2 in a predetermined diameter. The installation hole 2*a* allows the driving part 100 to pass therethrough and then is installed on the mounting part 2.

The bottom plate 3 has a first drain port 3*a* that is connected to the first drain hose 231 to deliver the water discharged to the outside the rotating tub 20 during a spin-dry operation.

The first drain hose 231 is connected to the second drain hose 230 to discharge water passing through a second drain port 201 to the outside the body 1 during a washing operation and a rinsing operation.

The rotating tub 20 is rotatably provided on an upper side of the mounting plate 2 in a vertical direction.

The rotating tub 20 includes a bottom part 24 and a side wall 21 that connects to the bottom part 24 to form a space accommodating a washing water.

A through-hole 150 is provided in the center of the bottom part 24 to allow a driving shaft 124 to be coupled thereto. A liquid balancer 25 is provided at the upper portion of the rotating tub 20 to ensure the smooth rotation of the rotating tub 20.

The side wall 21 is provided while being slanted with the increase of a diameter of the rotating tub 20. If the rotating tub 20 rotates at a speed of 280 rpm or above in a spin-dry operation, water separated from the laundry reaches to the side wall 21 due to the centrifugal force and runs to the upper side of the rotating tub 20 along the inner side of the side wall 21 slanted.

In this case, the side wall 21 forms a slope angle θ of 2 degrees to 10 degrees with respect to a line (L) that is perpendicular to the bottom part 24.

If the slope angle θ is smaller than 2 degrees, the water does not effectively move along the inner circumferential surface of the side wall 21, and thus the spinning performance is degraded. If the slope angle θ is larger than 10 degrees, the upper portion of the rotating tub 20 is widened, and thus the overall width is increased.

As described above, a plurality of drain holes 22 are formed at the upper portion of the rotating tub 20 to discharge the water separated from the laundry to the outside the rotating tub 20. The water discharged to the rotating tub 20 through the drain hole 22 flows to the bottom plate 3 of the mounting part 2 along an inner circumferential surface of the body 1, and then is discharged to the outside through the first drain port 3*a* and the first drain hose 231.

The drain hole 22 is formed along the circumferential direction of the side wall 21. The drain hole 22 is provided at a position corresponding to two-third of the height of the rotating tub 20.

The driving part 100 is installed at the lower portion of the rotating tub 20 to drive the rotating tub 20 or the pulsator 6 disposed inside the rotating tub 20.

Figure 6:
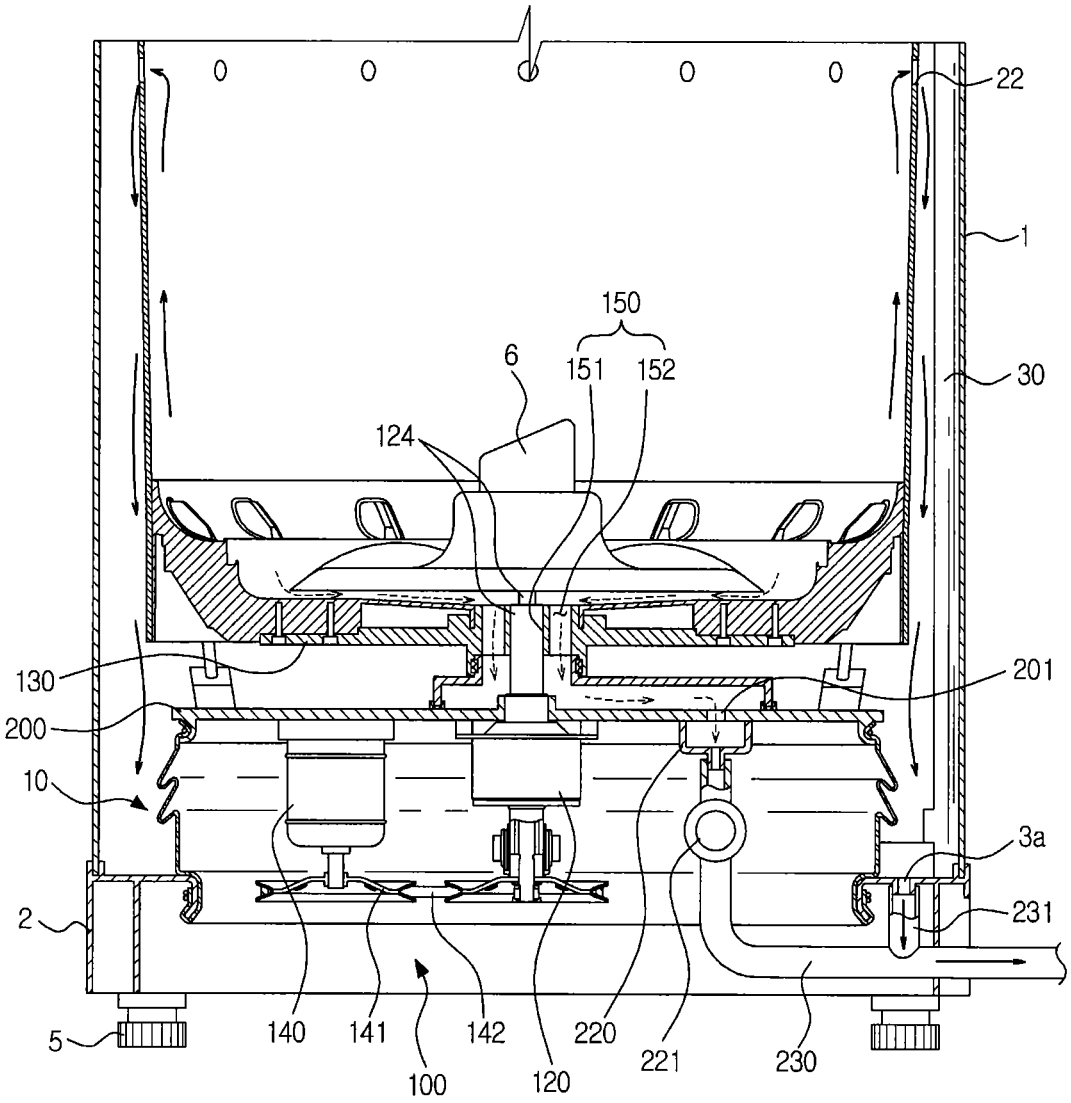
FIG. 6 is a view showing the flow of water during a washing operation and a spin-dry operation of the washing machine according to an embodiment.

The driving part 100 includes the clutch 120, the driving motor 110, a flange member 130 and the base plate 200. The clutch 120 selectively rotates the rotating tub 20 and the pulsator 6. The driving motor 110 drives the clutch 120. The flange member 130 connects the driving shaft 124 of the clutch 120 to the bottom part 24 of the rotating tub 20 to transmit a torque of the driving shaft 124 to the rotating tub 20. The base plate 200 is provided to fix the clutch 120 and the driving motor 110 (see FIGS. 1, 4, and 6).

Since the driving part 100 is fixed to a lower surface of the base plate 200 below the rotating tub 20, the driving part 100, after the spin-dry operation, may have a risk of being exposed to the water that runs down along the inner surface of the body 1 and then is discharged through the first drain port 3*a* of the bottom plate 3.

Accordingly, a waterproofing member 10 is provided between the base plate 200 and the bottom of the body 1 to seal the driving part 100.

In addition, the mounting part 2 includes a moisture infiltration preventing guide 30 configured to prevent water from being introduced to (reaching) a plurality of cables (C) connected to electronic parts of the driving part 100.

The moisture infiltration preventing guide 30 includes a cable accommodating part 30*a* that allows the cable (C) to pass therealong. The moisture infiltration preventing guide 30 is provided in a direction perpendicular to edges of the bottom plate 3 of the mounting part 2.

The waterproofing member 10 may include a diaphragm formed using elastically deformable material, such as rubber, to absorb the vibration of the driving part 100.

Figure 5:
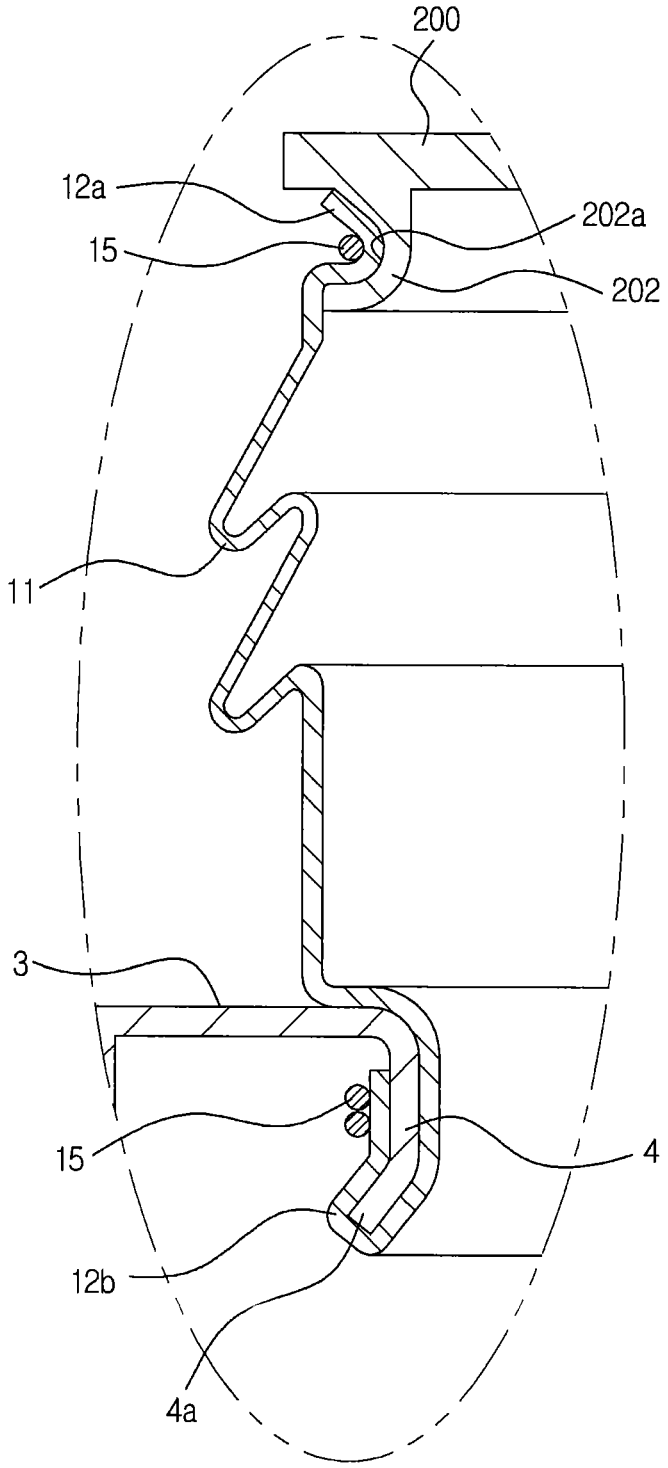
FIG. 5 is an enlarged view of a portion "A" of FIG. 4.

Referring to FIGS. 4 and 5, the waterproofing member 10 includes a plurality of wrinkled parts 11 and a fixing part 12 extending upward and downward.

The fixing part 12 includes a first fixing part 12*a* extending upward from the wrinkled part 11 and a second fixing part 12*b* extending downward from the wrinkled part 11.

The waterproofing material 10 is provided in the form of a cylinder surrounding the outer side of the driving part 100. The waterproofing material 10 is disposed between the base plate 200 and the bottom of the body 1, that is, between the base plate 200 and the bottom plate 3 of the mounting part 2.

The base plate 200 includes a first coupling part 202 having a coupling groove 202*a*. The first coupling part 202 protrudes from the lower surface of the base plate 200 along the circumference of the base plate 200 while extending outward such that the coupling groove 202*a* is coupled to the first fixing part 12*a* of the waterproofing member 10.

The first fixing part 12*a* has an upper end which is bent outward to correspond to the coupling groove 202*a* of the first coupling part 202.

A wire 15 having a shape of a ring is configured to fasten the outer circumference of the first coupling part 202 of the base plate 200 and the first fixing part 12*a* of the waterproofing member 10, thereby allowing the first coupling part 202 to be closely fixed to the first fixing part 12*a*.

The second fixing part 12*b* of the waterproofing member 10 is coupled to a second coupling part 4 that is formed on the mounting part 2.

The installation hole 2*a* is provided in the center of the bottom plate 3 of the mounting part 2. The second coupling part 4 is provided on the rim of the installation hole 2*a*.

The second coupling part 4 extends downward from the bottom plate 3. The second coupling part 4 is provided at an end thereof with a slanting part 4*a* that extends while being slanted in a radial outward direction.

The second fixing part 12*b* of the waterproofing member 10 has a shape corresponding to the shape of the second coupling part 4 such that the second fixing part 12*b* is inserted into the second coupling part 4. A wire 15 having a shape of a ring fastens the outer circumference of the second fixing part 12*b* that is inserted to the second coupling part 4, thereby allowing the second fixing part 12*b* to be closely fixed to the second coupling part 4.

The first coupling part 4 and the second coupling part 4 may be implemented in variety of shapes so that the fixing member 12 of the waterproofing member 10 can be firmly fixed to the first coupling part 202 and second coupling part 4.

According to the above configuration, the waterproofing member 10 is provided between the base plate 200 and the bottom of the body 1 while surrounding the outer side of the driving part 100 to seal the driving part 100 and water is prevented from being infiltrated into (reaching) the driving part 100, and the vibration of the driving part 100 is absorbed.

In addition, a vertical vibration is absorbed without impeding the rotation of the rotating tub 20 during the washing operation or the spin-off operation, thereby enhancing the washing efficiency.

When a draining process is viewed during the washing operation and the spin-off operation, a water (shown as a solid arrow line in FIG. 6) separated during the spin-off operation is discharged to the outer side of the rotating tub 20 through the drain hole 22 of the rotating tub 20, flows downward along the inner surface of the body 1, and then is discharged by sequentially passing through the first drain port 3*a* formed through the bottom plate 3, the first drain hose 231 and the second drain hose 230 connected to the first drain port 3*a*.

The through-hole 150 of the rotating tub 20 is provided to allow the rotating tub 20, the driving shaft 124 of the driving part 100, and the flange member 130 to be coupled thereto. The through-hole 150 includes a first through-hole 151, which is provided in the center of the through-hole 150, and a second through-hole 152 disposed around the first through-hole 151 in the circumferential direction of the first through-hole 151.

The first through-hole 151 is formed such that the driving shaft 124 is connected to the rotating tub 20 and the pulsator 6 by passing through the flange member 130. The second through-hole 152 is formed to discharge water, which remains in the rotating tub 20 after the washing operation is finished, to the outside the rotating tub 20 through the second drain port 201.

In addition, the driving shaft 124 includes a first driving shaft 124*a*, which is coupled to the first through-hole 151, and a second driving shaft 124*b*, which extends from the first driving shaft 124*a* and is coupled to the pulsator 6.

The first driving shaft 124*a* and the second driving shaft 124*b* simultaneously or individually rotate depending on whether a washing operation is performed or a spin-off operation is performed.

In a washing operation, the second driving shaft 124*b* operates to rotate the pulsator 6 that is coupled to the second driving shaft 124*b*. During a spin-off operation, the first driving shaft 124*a* and the second driving shaft 124*b* operate such that the rotating tub 20 and the pulsator 6 simultaneously rotate.

One end of the driving shaft 124 is connected to the pulley 141 such that a driving force of the driving motor 110 is transferred to the clutch 120.

In addition, the base plate 200 has a base plate cover 210 to guide water discharged through the second through-hole 152.

The base plate cover 210 is disposed between the flange member 130 and the base plate 200 to house the second drain port 201 that is formed on the base plate 200.

A drain case 220 is coupled to a lower portion of the base plate 200 to form a predetermined space. The space is configured to accommodate a washing water that is introduced by passing through a space formed between the base plate cover 210 and the base plate 200.

One end of the drain case 220 is connected to the second drain hose 230 to guide a washing water introduced to the drain case 220 to the outside the body 1.

A valve 221 is provided on the second drain hose 230 to selectively drain water.

In this manner, the water having been used for the washing operation or the rinsing operation (shown as a dotted line arrow in FIG. 6) is introduced into the space between the base plate cover 210 and the base plate 200 by passing through the second through hole 152 and then is discharged to the outside the body 1 by sequentially passing through the drain case 220 and the second drain hose 230.

In each of the washing operation, the rinsing operation and the spin-off operation, the driving part 100 provided at the lower portion of the rotating tub 20 is completely sealed by the waterproofing member 10 provided between the base plate 200 and the bottom plate 3 of the body 1, thereby preventing water from being infiltrated into (reaching) the driving part 100.

In addition, the cable (C) connected to the driving part 100 is also prevented from being exposed to water by the cable accommodation part 30*a* formed on the bottom plate 3.

In addition, the waterproofing member 10 surrounds the outer side of the driving part 100, thereby preventing vibration and noise from the driving part 100.

As described above, a structure to accommodate water between the body 1 and the rotating tub 20 is removed, so that the spatial utilization in the body 1 is maximized. In addition, the waterproofing member 10 provided at the lower portion of the rotating tub 20 serves to absorb the up-and-down vibration of the rotating tub 20 and the vibration of the driving part 100 and also prevents the water from being introduced to the electronic parts of the driving part 100.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a body;

a rotating tub rotatably disposed inside the body;

a pulsator rotatably disposed inside the rotating tub;

a driving part provided on a lower portion of the rotating tub to selectively rotate the rotating tub and the pulsator; and a base plate to which the driving part is fixed, wherein the driving part is fixed to a lower surface of the base plate, and wherein a waterproofing member is provided between the base plate and a bottom of the body to seal the driving part and to prevent water from reaching the driving part, and both ends of the waterproofing member are respectively coupled with the base plate and the bottom of the body.

2. The washing machine of claim 1, wherein the waterproofing member comprises a diaphragm configured to absorb vibration of the driving part.

3. The washing machine of claim 1, wherein the waterproofing member comprises a plurality of wrinkled parts, a first fixing part extending upward from the wrinkled part, and a second fixing part extending downward from the wrinkled part.

4. The washing machine of claim 3, wherein the base plate comprises a first coupling part which is provided at a lower surface of the base plate such that the first coupling part is coupled with the first fixing part.

5. The washing machine of claim 3, further comprising a mounting part configured to support the body, wherein the mounting part comprises a bottom plate forming the bottom of the body and a second coupling part which is provided at a lower surface of the bottom plate to be coupled with the second fixing part.

6. The washing machine of claim 3, wherein the waterproofing member further comprises a wire which is provided in a form of a ring and configured to press and fix each of outer sides of the first fixing part and the second fixing part.

7. The washing machine of claim 5, wherein the mounting part further comprises a moisture infiltration preventing guide configured to prevent water from reaching a cable that is connected to one or more electronic parts of the driving part.

8. The washing machine of claim 7, the moisture infiltration preventing guide is vertically provided inside the body.

9. The washing machine of claim 5, wherein the rotating body comprises a side wall that extends from a bottom of the rotating body while being slanted with increase of a diameter, and at least one drain hole is formed in an upper end portion of the side wall.

10. The washing machine of claim 9, wherein the bottom plate is provided with a first drain port configured to discharge a washing water that is discharged through the drain hole and fallen.

11. The washing machine of claim 1, wherein:

the driving part comprises a motor, a clutch configured to selectively transfer a power of the motor to the rotating tub and the pulsator, and a flange connecting a driving shaft of the clutch to a bottom of the rotating tub, and the flange comprises a first through-hole, which is provided in a center of the flange to allow the driving shaft to be coupled thereto, and a second through-hole, which is formed around the first through-hole in a circumferential direction of the first through-hole to pass water during a washing operation and a rinsing operation.

12. The washing machine of claim 11, wherein the base plate is provided with a second drain port configured to discharge a washing water that is discharged through the second through-hole and fallen during a washing operation or a rinsing operation.

13. The washing machine of claim 1, further comprising a suspension member connecting the base plate to a upper portion of the body, wherein the suspension member has a first end connected to at least one connecting bracket, which is provided on the base plate, and a second end connected to an upper edge of the body.

14. A washing machine comprising:

a body forming an external appearance;

a rotating tub which is rotatably installed inside the body and is provided at a lower portion thereof with a driving part;

a base plate which is connected to an upper portion of the body by at least one suspension member such that the driving part is fixed to a lower surface of the base plate; and a diaphragm disposed between the base plate and a bottom of the body to seal the driving part and to absorb vibration, wherein both ends of the diaphragm are respectively coupled with the base plate and the bottom of the body.

15. The washing machine of claim 14, wherein the diaphragm comprises a plurality of wrinkled parts and a fixing part extending upward and downward from the wrinkled parts.

16. The washing machine of claim 15, wherein the base plate comprises a coupling groove that is formed by protruding a lower surface of the base plate such that a first side of the fixing part is fixed to the base plate.

17. The washing machine of claim 15, wherein:

a bottom of the body is provided at a center thereof with an installation hole that allows the driving part to pass therethrough, and a rim of the installation hole is bent downward such that a second side of the fixing part is fixed to the rim.

18. The washing machine of claim 15, further comprising a wire which is provided in a form of a ring and configured to press and fix an outer circumference of the fixing part.

19. The washing machine of claim 17, further comprising a moisture water infiltration preventing guide which is provided on the bottom of the body to prevent water from reaching a cable that is connected to one or more electronic parts of the driving part.

* * * * *